United States Patent [19]

Tank

[11] Patent Number: 4,943,413

[45] Date of Patent: Jul. 24, 1990

[54] PROCESS FOR PRODUCING AN ALUMINUM/MAGNESIUM ALLOY

[75] Inventor: Eggert Tank, Wernau, Fed. Rep. of Germany

[73] Assignee: Daimler-Benz AG, Fed. Rep. of Germany

[21] Appl. No.: 305,118

[22] Filed: Feb. 2, 1989

[30] Foreign Application Priority Data

Mar. 8, 1988 [DE] Fed. Rep. of Germany ..... 3807541

[51] Int. Cl.[5] ..... C22C 1/03

[52] U.S. Cl. ..... 420/528; 420/542

[58] Field of Search ..... 420/528, 542, 590

[56] References Cited

FOREIGN PATENT DOCUMENTS 3247535 7/1983 Fed. Rep. of Germany .

*Primary Examiner*—R. Dean

*Attorney, Agent, or Firm*—Evenson, Wands, Edwards, Lenahan & McKeown

[57] ABSTRACT

A process for producing an aluminum/magnesium alloy containing refractory material particles is described, wherein a particle-rich magnesium pre-alloy is first produced and from which the appropriate aluminum/-magnesium alloy is then obtained by dissolution in aluminum.

5 Claims, No Drawings

PROCESS FOR PRODUCING AN ALUMINUM/MAGNESIUM ALLOY

BACKGROUND AND SUMMARY OF THE INVENTION

The invention relates to a process for producing an aluminum/magnesium alloy containing refractory material particles.

In the course of the development of aluminum-based composite materials, so-called metal matrix composites, composite materials consisting of aluminum alloys containing refractory material particles have also been developed. The incorporation of the particles into the alloy, especially fine particles, changes the properties of the aluminum base material in a known manner. The particle-reinforced aluminum composite materials have: (1) a higher heat resistance than known aluminum alloys; (2) a higher modulus of elasticity and (3) a smaller thermal expansion . In addition, the wear resistance is substantially improved The incorporation of the refractory material particles into the alloy thus considerably widens the existing limits of the application of aluminum alloys, especially for use in higher temperature applications. Particle-reinforced aluminum composite materials of this type have therefore been developed for use in aerospace, in automobile construction and in general machine engineering. However, because liquid aluminum and its alloys did not sufficiently wet the normally used refractory material particles, or did not wet them at all, these composite materials are predominantly produced by the known methods of powder metallurgy. That is by mixing of Al and refractory material powder; then filling the mixture into special containers; then outgassing in vacuo (a space devoid of air), and then compacting of the mixture by cold and hot isostatic pressing or by extrusion. In this case, a large number of parameters must be very accurately controlled and adhered to. For these reasons these materials are therefore expensive to produce.

It is the object of the invention to provide a process, by means of which aluminum alloys containing refractory material particles can be produced simply and inexpensively.

This object is obtained by preparing a refractory material particle charge from any of $B_4C$, $Si_3N_4$, SiC, $Al_2O_3$, $3Al_2O_s.2SiO_2$, $Al_2O_3.MgO$ or $ZrO_2$ in pure form or in the form of a mixture and then heating this to between 680 to 800° C. in a completely filled mold. The voids existing between the particles of this material are then filled with either a hot molten magnesium, or with a magnesium/aluminum alloy with up to 32% by weight of aluminum, at 680 to 800° C. Then this void filled pre-alloy is dissolved in either an aluminum melt, or alloy that does not exceed a magnesium content of 11% by weight, relative to the metal fraction in the resulting alloy.

The process is thus based on the fact that a pre-alloy, which has a high content of refractory material particles and readily wets the latter, is first prepared and then this pre-alloy is dissolved in an aluminum melt or an aluminum alloy melt. The pre-alloy is prepared in such a way that a refractory material particles charge is heated in a mold to between 680 to 800° C., that is to say, to the usual casting temperature. At that temperature range, the voids existing in the charge between the particles are filled with hot molten magnesium, or a magnesium/aluminum alloy with up to 32% by weight of aluminum. It is preferred to carry out this filling or infiltration in such a way that the voids in the refractory material particles charge are filled from below, i.e. is to have the magnesium or the magnesium alloy introduced from the bottom of the mold. This allows good outgassing and easy escape of the gases contained in the refractory material particles charge. Floating of the refractory material particles charge is expediently prevented by a hold-down device which is pressed down on the charge and which can consist, for example, of wire netting or another porous material which does not impede the escape of the gases from the charge. The size of the refractory material particles can be between 1 and several hundred μm. Particle sizes between 2 and 200 μm are normally preferred choice.

Those refractory material particles are preferred which have hardnesses above 1200 HV of all oxidic, nitridic and carbidic refractory materials. In particular SiC, $B_4C$, $Si_3N_4$, $Al_2O_3$, $3AL_2O_3.2SiO_2$, $Al_2O_3$. , MgO, $ZrO_2$ and others make for good refractory material particles. The refractory materials can be used either in the pure form or in the form of mixtures of various refractory materials. In the case of the carbidic and nitridic refractory materials, a pre-oxidation of the particle surface can facilitate wetting of the particles by magnesium. This pre-oxidation can be effected by exposing the particles to air at elevated temperatures for a period of time to form a thin oxide skin on the particles which thin oxide skin facilitates wetting.

For the infiltration, that is for filling the interstices of the powder charge with the magnesium or the magnesium alloy, the refractory material particles are first preheated in a die or mold to the casting temperature of the molten magnesium or magnesium alloy (i.e. to about the range of 680 to 800° C.) and then infiltrating with the magnesium or magnesium/aluminum alloy which has been brought to the same temperature. In general, this infiltration is carried out without pressure but, in the case of very high powder charges, it is entirely possible to apply pressure. The infiltration is carried out with pure magnesium, or with a magnesium alloy which can contain up to 32% by weight of aluminum. In the case of higher aluminum contents, wetting of the refractory material particles by the alloy decreases, so that the powder charge can no longer be completely filled with the alloy. The volume fraction of the refractory material particles in the pre-alloy can be adjusted by the ratio of the refractory material particles to the metal alloy. The maximum possible volume fraction of refractory material particles in the pre-alloy corresponds to the volume fraction of the refractory material particles in the charge.

In a further process step, the pre-alloy prepared in this way is dissolved in molten aluminum. It is preferred to not add the pre-alloy to the aluminum until just before processing of the aluminum. The pre-alloy is normally added by introducing it in the solid state, (if necessary after preheating it to approximately 300° C.) to the molten aluminum or the molten aluminum alloy in a ladle. The dissolution of the pre-alloy bodies can be accelerated by moving the aluminum melt. When the pre-alloy body has dissolved, the refractory material particles are suspended in the resulting aluminum/magnesium melt and settle out only very slowly. In exceptional cases, it can also be possible to add the pre-alloy immediately after its preparation and when still in the molten state, to the aluminum melt. Before and during casting of the aluminum alloy, the suspended state of the melt must be maintained by slight bath agitation.

After solidification, the refractory material particles are found to be in a completely uniform distribution in the aluminum alloy. The quantity of magnesium pre-alloy added to the molten aluminum must be such that a magnesium content of 11%, relative to the metal content of the finished alloy, is not exceeded. This is because the properties of the alloy deteriorate at higher magnesium contents. The refractory material content in the finished alloy can be adjusted by the quantity of added pre-alloy. Particularly high refractory material contents can be achieved, if an aluminum-containing pre-alloy is used, since more refractory material can then be introduced into the alloy before the upper limit of 11% by weight of magnesium in the metal of the finished alloy is reached.

EXAMPLE

A 10 mm high powder charge of silicon carbide particles of F 500 grid number was introduced into a mold of 26 mm internal diameter. F 500 means that 50% of all the particles have a size between 11.8 and 13.8 $\mu$m (according to sedimentation analysis as specified in DIN 69 101). This powder charge has a bulk density of 1.28 g per $cm_3$ and hence a space filling of 40% by volume. The mold was heated for 2 hours in air to the infiltration temperature of 750° C. After the infiltration temperature of 750° C. had been reached, the mold was infiltrated from the bottom with molten magnesium. Floating of the powder charge was prevented by a wire netting. After cooling, it was possible to take a preform of 26 mm diameter, 10 mm height and 12.53 g weight, which had a silicon carbide particle content of 40% by volume, from the mold.

This preform was dissolved in a melt of 46.37 g of pure aluminum. This gave an alloy which contained 11% by weight of magnesium, relative to the metal fraction, and 9.4% by volume of silicon carbide particles. A marked improvement with respect to the heat resistance, the modulus of elasticity, the thermal expansion and the wear resistance is achieved with this refractory material content.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Process for producing an aluminum-containing alloy containing refractory material particles, comprising:

preparing a refractory material particles charge from any one of $B_4C$, $Si_3N_4$, SiC, $Al_2O_3$, 3 $Al_2O_32SiO_2$, $Al_2O_3.MgO$ or $ZrO_2$ in the pure form or in the form of mixtures of various such refractory materials;

then heating said refractory material particles charge to between 680 to 800° C. in a mold completely filled with said refractory material particles charge;

then preparing a pre-alloy in the mold by filling the voids existing between particles of the refractory material particles charge with either hot molten magnesium, or a magnesium/aluminum alloy with up to 32% by weight of aluminum, at 680 to 800° C.;

and then dissolving this void filled pre-alloy in either an aluminum melt, or alloy that does not exceed a magnesium content of 11% by weight, relative to the metal fraction in the resulting alloy.

2. The process according to claim 1, wherein the voids in the refractory material particles charge are filled from below.

3. The process according to claim 1, wherein the refractory material particles have a grain size between 2 and 100 $\mu$m.

4. The process according to claim 2, wherein the refractory material particles have a grain size between 2 and 100 $\mu$m.

5. A process according to claim 1, wherein the dissolving step is not carried out until just before making of the alloy.

* * * * *